US005732686A

United States Patent [19]

Yokoyama et al.

[11] Patent Number: 5,732,686

[45] Date of Patent: Mar. 31, 1998

[54] AIR VENT APPARATUS FOR CARBURETOR

[75] Inventors: Takashi Yokoyama; Koki Kobayashi; Kenichi Nishizawa, all of Saitama, Japan

[73] Assignee: Honda Giken Kogyo Kabushiki Kaisha, Tokyo, Japan

[21] Appl. No.: 474,486

[22] Filed: Jun. 7, 1995

[30] Foreign Application Priority Data

Sep. 28, 1994 [JP] Japan ..... 6-233809

[51] Int. Cl.[6] ..... F06M 37/04

[52] U.S. Cl. ..... 123/516; 123/520; 123/517

[58] Field of Search ..... 123/516, 520, 123/519, 518, 521, 517

[56] References Cited

U.S. PATENT DOCUMENTS

| | | | |
|---|---|---|---|
| 2,965,086 | 12/1960 | Gregory | 123/520 |
| 3,093,124 | 6/1963 | Weintworth | 123/517 |
| 3,221,724 | 12/1965 | Weintworth | 123/520 |
| 3,460,522 | 8/1969 | Kittler | 123/520 |
| 3,575,152 | 4/1971 | Wentworth | 123/520 |
| 3,802,403 | 4/1974 | Dewick | 123/520 |
| 4,326,489 | 4/1982 | Heitert | 123/520 |
| 4,377,146 | 3/1983 | Onidi | 123/520 |
| 4,432,328 | 2/1984 | Shimizu | 123/520 |
| 4,495,904 | 1/1985 | Sakaino | 123/520 |
| 4,527,532 | 7/1985 | Kasai | 123/520 |

FOREIGN PATENT DOCUMENTS

| | | | |
|---|---|---|---|
| 0041724 | 3/1977 | Japan | 223/577 |
| 3-87956 | 9/1991 | Japan . | |
| 6-185414 | 7/1994 | Japan . | |
| 746245 | 3/1956 | United Kingdom . | |

OTHER PUBLICATIONS

Patent Abstracts of Japan, vol. 11, No. 269 (M-621), JP 62-070,649.

Patent Abstracts of Japan, vol. 16, No. 343 (M-1285), JP 4-103,862.

Patent Abstracts of Japan, vol. 10, No. 171 (M-489), JP 61-019,955.

*Primary Examiner*—Carl S. Miller

*Attorney, Agent, or Firm*—Birch, Stewart, Kolasch & Birch, LLP

[57] ABSTRACT

A fuel carbureted in a float chamber of a carburetor is prevented from entering through an air vent path into an air intake path during low velocity running of a vehicle. An outer vent path and an inner vent path are provided on the upstream side of an air vent path which communicates with a float chamber of a carburetor of an engine for a vehicle. The paths are alternatively selected by a solenoid valve. An opening of the inner vent path is opened in the intake duct, and an opening of the outer vent path is opened at a position sufficiently spaced away from the front face air intake. During low velocity running, the solenoid valve is selectively operated so that the outer vent path is in communication with the carburetor. During high velocity running, however, the inner vent path is in communication with the carburetor.

24 Claims, 15 Drawing Sheets

AIR VENT APPARATUS FOR CARBURETOR

BACKGROUND OF THE INVENTION

1. Field of the Invention

This invention relates to an air vent apparatus for eliminating the disadvantage that fuel carbureted in a float chamber of a carburetor enters an air intake path by way of an air vent path particularly during low velocity operation.

2. Description of the Background Art

An air vent apparatus which is in communication with a float chamber of a carburetor of an engine for a vehicle is disclosed in the official gazette of Japanese Utility Model Laid-Open Application No. Heisei 3-87956. In the air vent apparatus, an atmospheric air vent path which is in communication with the atmospheric air is provided in addition to an air vent path which is in communication with an air intake path. The two paths are alternatively used by means of a change-over valve which operates in response to a negative pressure of intake air to an engine. Further, in this apparatus, while the engine is at rest, the atmospheric air vent path side and the float chamber are in communication with each other by means of the change-over valve, but while the engine is operating, the intake air path and the float chamber are in communication with each other by means of the change-over valve.

In the air vent apparatus described above, the change-over valve is operated by a negative pressure of intake air to the engine. While the engine is operating, the air intake path and the float chamber are in communication with each other irrespective of the running velocity, particularly when the vehicle is running at a low velocity. Fuel carbureted in the float chamber by the heat of the engine is thereby caused to flow back into the air intake path. This fuel gas is sometimes taken into the carburetor, resulting in degradation of the fuel air rate.

SUMMARY AND OBJECTS OF THE INVENTION

In order to solve the problem described above, according to the present invention, an air vent apparatus for a carburetor has an air vent path which communicates with a float chamber of a carburetor of an engine for a vehicle. The air vent path is alternatively connected to one of the atmospheric air and an air intake path by a change-over valve. The change-over valve is operated in response to on/off operation of an engine starter switch and a predetermined velocity of the vehicle. Further, an opening on the atmospheric air side is alternatively rendered effective by the change-over valve. This opening is provided at a location where a pressure equal to the pressure of intake air acts and carbureted gas which flows back is not retaken into the air intake path. This change-over valve is an electromagnetic change-over valve.

Further, a flow path changing member which is changed over at a predetermined velocity of the vehicle is provided in the air intake path, and an air intake to the air intake path is alternatively selected by changing over of the flow path changing member. Further, one of the air intakes is provided at a location where the air intake is less likely effected by a variation in pressure and admission of water is less likely. Furthermore, the predetermined velocity of the vehicle at which the flow path changing member is changed over is equal to the predetermined velocity of the vehicle at which the change-over valve of the air vent path is operated.

Operation of the change-over valve for changing over the air vent path is controlled in response to on/off operation of the engine starter switch and also in response to the predetermined velocity of the vehicle. For example, when the engine starter switch is on and the vehicle is running at a low velocity, the air vent path is in communication with the atmospheric air at a location where carbureted gas is not retaken in, but when the vehicle is running at a high velocity, the air vent path is in communication with the air intake path. Consequently, when the vehicle is running at a low velocity, fuel carbureted in the float chamber flowing back into the air intake path will not occur. Further, since the location of the opening to the atmospheric air is selected as a location where a pressure equal to the pressure of intake air acts, the balance between the air pressure in the air intake path and the air pressure in the air vent path can be maintained.

Further, if a pressure variation occurs on the air intake side due to a gust of wind or the like while the air vent path is in communication with the atmospheric air side, then a difference in air pressure may possibly be produced between the intake air and the air in the air vent path and cause a loss of the balance, when the vehicle is running at a low velocity that allows the air vent path to be communicated with the atmospheric air side. The flow path changing member in the air intake path is, however, changed over simultaneously with changing over of the change-over valve. Therefore, the air intake is at the location where it is less likely to be effected by a gust of wind or the like in order to maintain the balance with the air pressure in the air vent path.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS OF THE INVENTION

Figure 1:
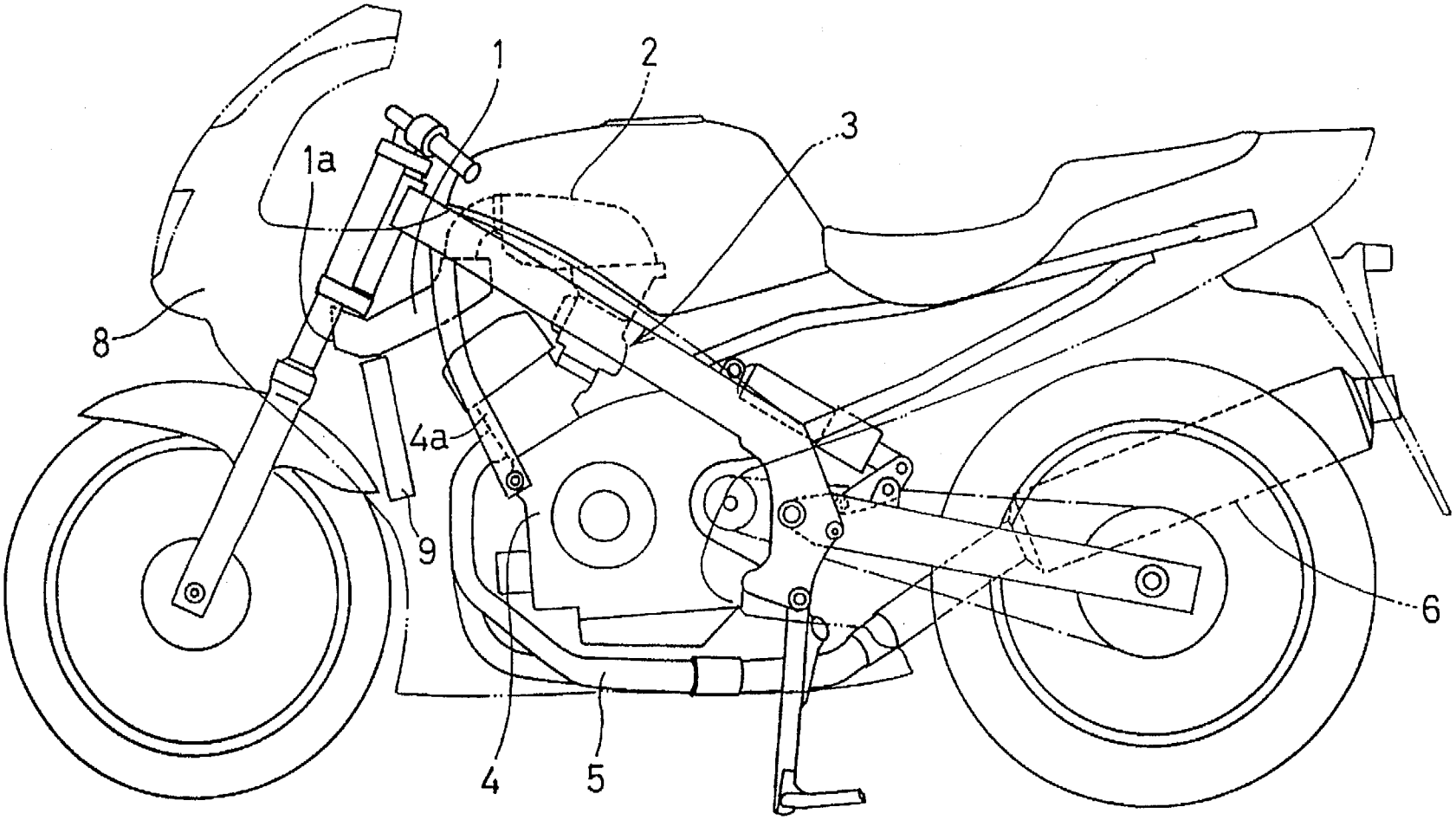
FIG. 1 shows a side view of a motorcycle to which an air vent apparatus for a carburetor of the present invention is applied.

The embodiments of the present invention will now be described with reference to the accompanying drawings. Referring to FIG. 1, an engine intake system of the motorcycle includes an intake duct 1 serving as an air intake path having a front face air intake 1*a* on a front face of a body, an air cleaner 2 connected to the intake duct 1, and a carburetor 3 connected to the air cleaner 2. Air and fuel are mixed at a predetermined mixture ratio in the carburetor 3 and supplied into a cylinder portion 4*a* of an engine 4. As an exhaust system of the engine 4, a muffler 6 is connected by way of an exhaust pipe 5 and extends rearwardly of the body. It is to be noted that, in FIG. 1, a cowling 8 and a radiator 9 are provided.

Figure 6:
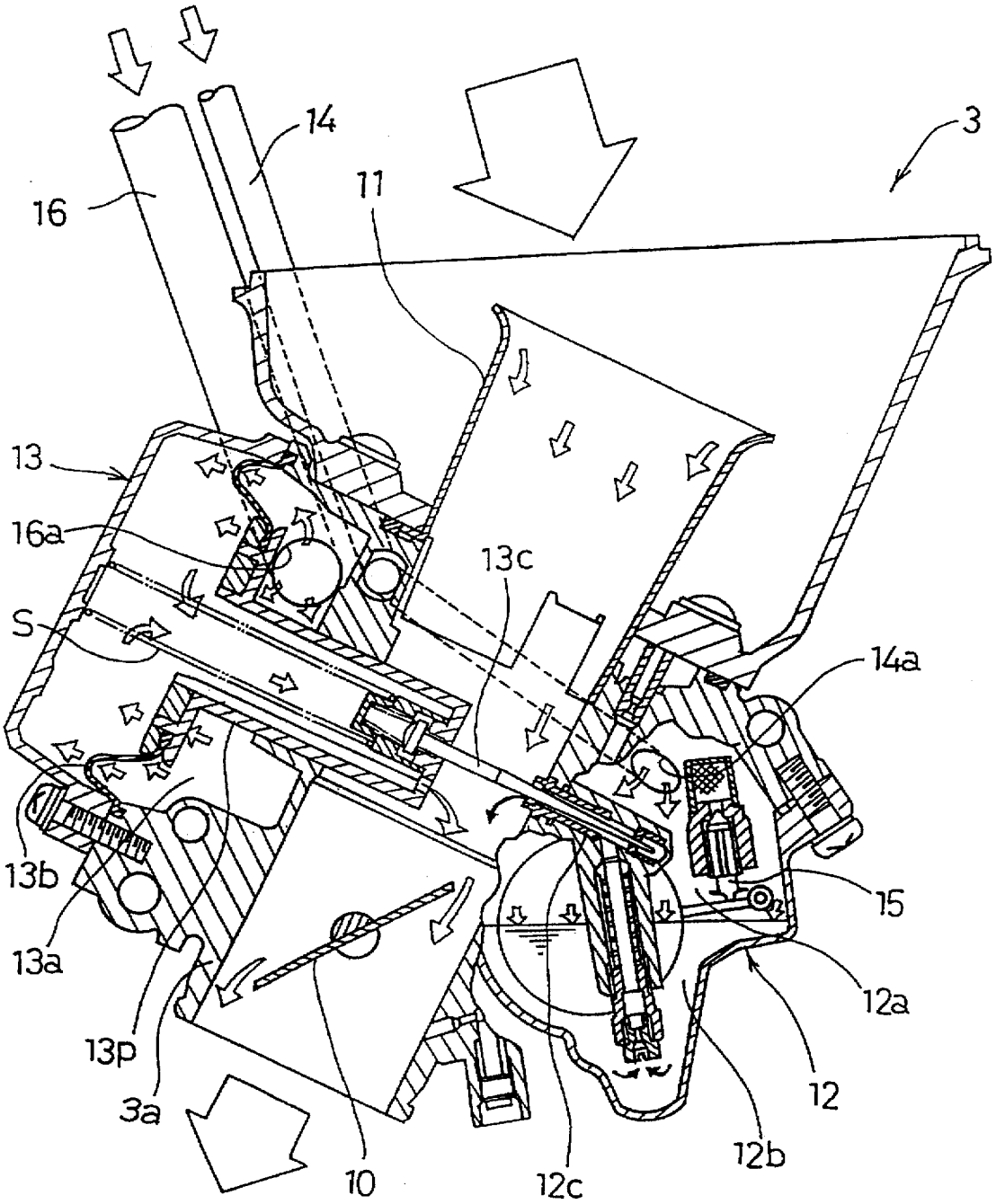
FIG. 6 shows an internal structure illustrating operation of the carburetor.

Before an air vent apparatus of the present invention is described, an outline of operation of the carburetor 3 will be described with reference to FIG. 6. The carburetor 3 includes a carburetor body 3*a* on which a venturi portion is formed, a float chamber 12 for supplying fuel to the venturi portion of the carburetor body 3*a*, and a diaphragm chamber 13 for varying the venturi diameter. An end opening 14*a* of an air vent path 14 on the downstream side is opened to an air staying portion 12*a* at an upper portion of the float chamber 12.

Meanwhile, a fuel staying portion 12*b* is provided at a lower portion of the float chamber 12. A needle valve 15 is moved upwardly or downwardly by upward or downward movement of a float (not shown) floating on the level of the fuel staying portion 12*b* so that the fuel in the fuel staying portion 12*b* may be kept at a fixed level. As the air pressure in the air staying portion 12*a* rises, the fuel pressure in a needle jet 12*c* rises.

An end opening 16*a* of a diaphragm air path 16 is opened to a lower chamber 13*a* of the diaphragm chamber 13 so that a diaphragm 13*b* is controlled by a pressure difference between the air pressure supplied from the diaphragm air path 16 and the pressure in the venturi portion. A piston 13*p* is provided integrally on the diaphragm 13*b*. A jet needle 13*c* which is biased by a spring s is provided at an end of the piston 13*p* and inserted in the needle jet 12*c*.

Consequently, if the running velocity rises and the air pressures in the air vent path 14 and the diaphragm air path 16 rise, then as the diaphragm 13*b* is expanded, the piston 13*p* is advanced against the force of the spring s so that the venturi diameter is expanded and the amount of air is increased. Simultaneously, the gap between the jet needle 13*c* and the needle jet 12*c* is increased and the amount of fuel to be jetted from within the needle jet 12*c* in which the fuel pressure has risen is increased. Accordingly, the mixture ratio between the amounts of air and fuel passing through the venturi portion is kept in good balance. Incidentally, a throttle valve 10 is shown.

In such a construction of the carburetor 3 as described above, the air vent apparatus of the present invention is constructed such that a plurality of air vent paths are connected to the upstream side of the air vent path 14 on the downstream side which is opened to the air staying portion 12*a* of the float chamber 12. Therefore, one of the paths is alternatively used in response to on/off operation of an ignition plug and the velocity of the vehicle. In the following, the air vent apparatus will be described with reference to FIG. 2 to 5.

Figure 2:
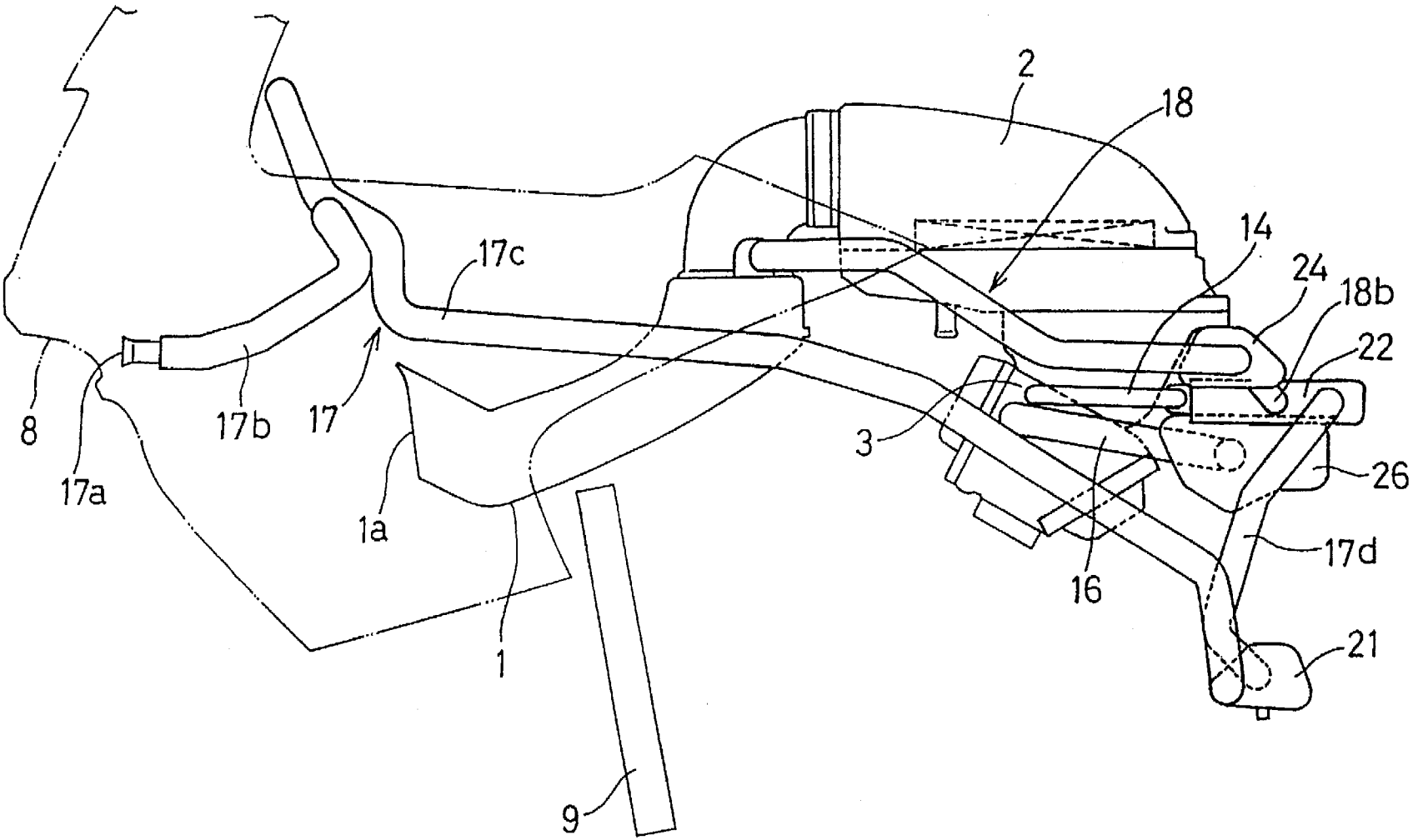
FIG. 2 shows an enlarged view of an essential part of the air vent apparatus for a carburetor as viewed from the direction of FIG. 1.
Figure 3:
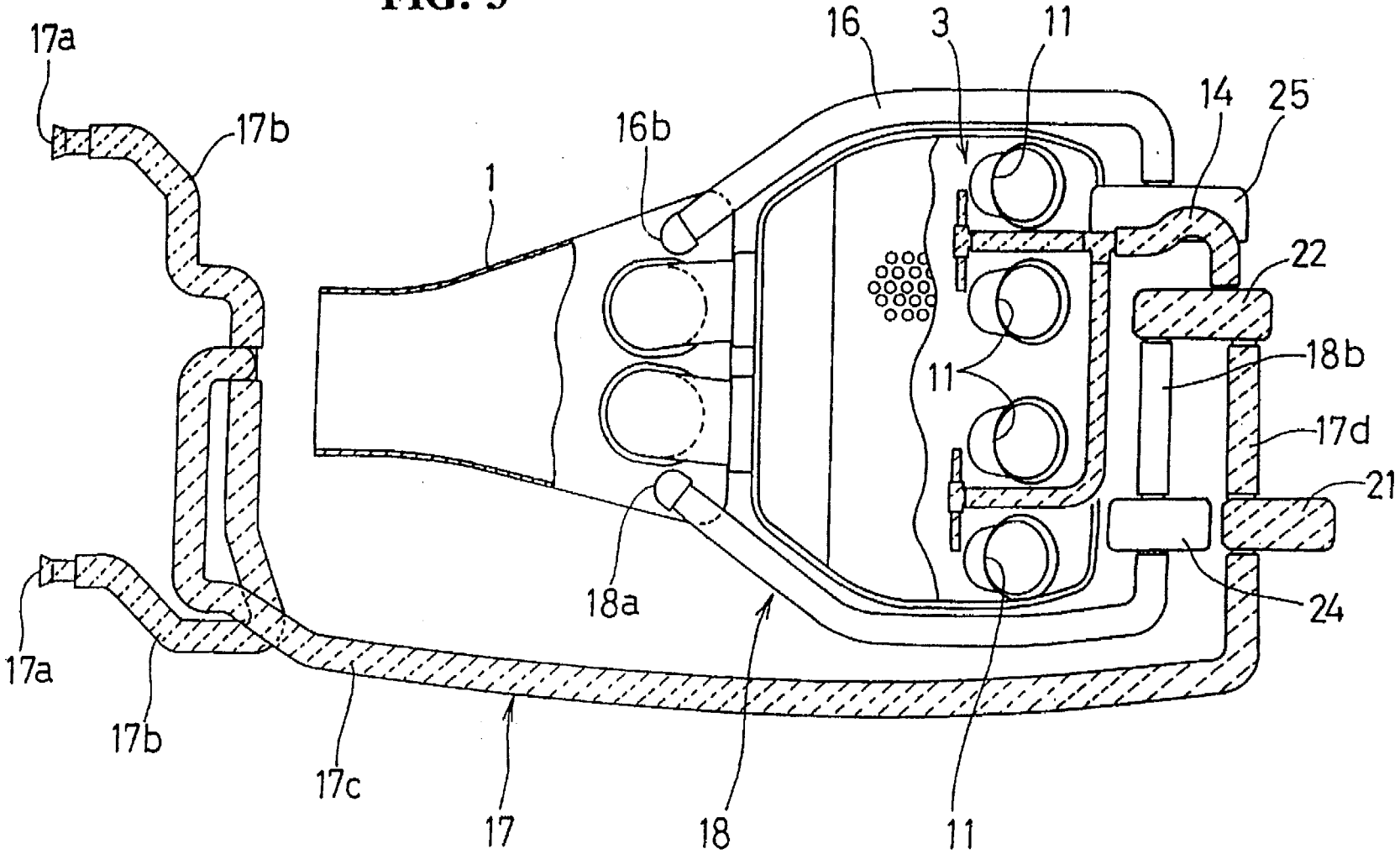
FIG. 3 shows an operation diagram as viewed in plan of FIG. 2 and a view of a communication condition of a vent path when an ignition plug is on and the velocity is 0 to 20 km/H.
Figure 4:
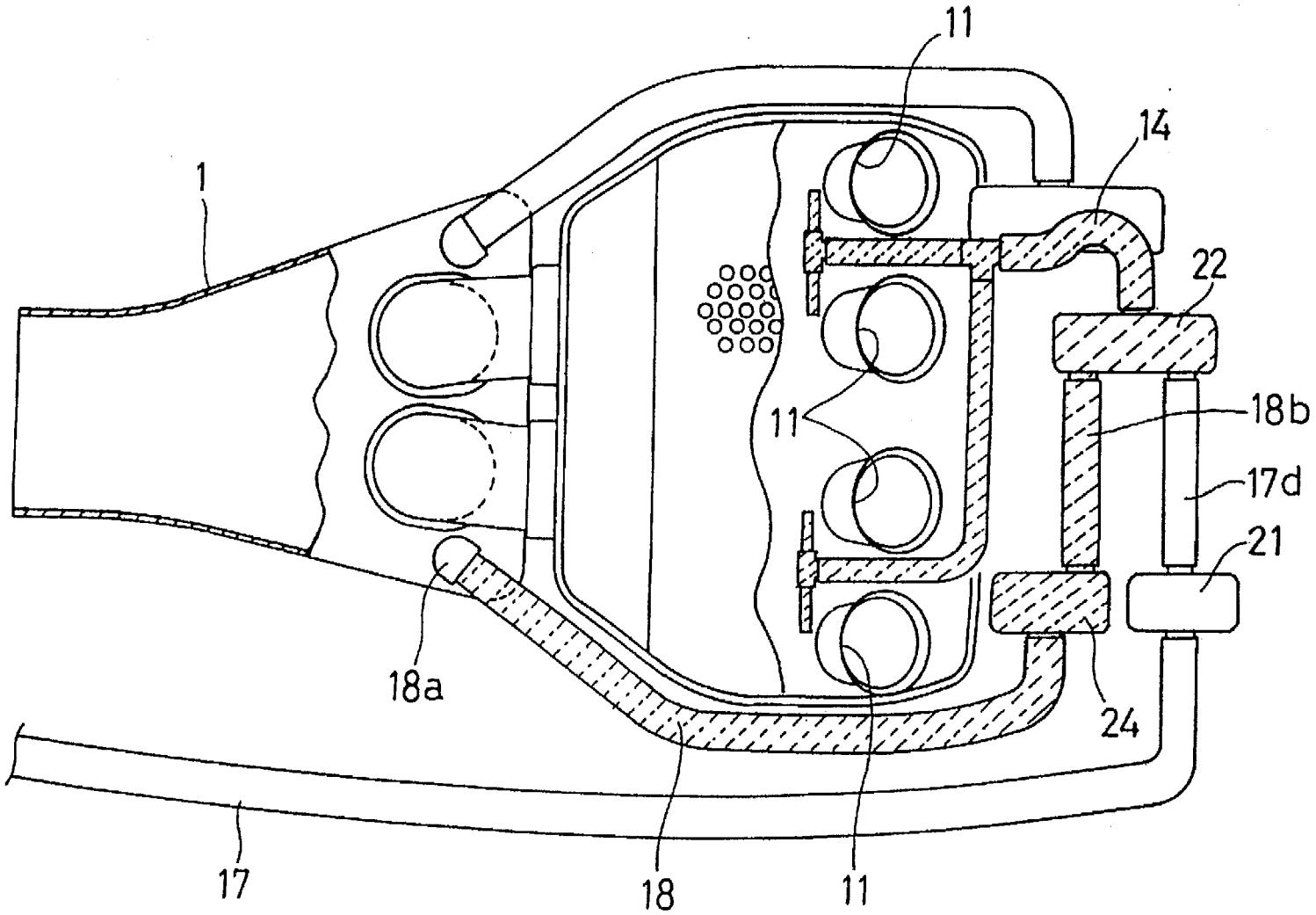
FIG. 4 shows an operation diagram as viewed in plan of FIG. 2 and a view of a communication condition of the vent path when the velocity is equal to or lower than 20 km/H.

As air vent paths on the upstream side of the air vent path 14, an outer vent path 17 which is opened to the cowling 8 and an inner vent path 18 which is opened to the intake duct 1 are provided as shown in FIGS. 2 and 3. The outer vent path 17 includes a collecting pipe 17*c* to which two branch pipes 17*b*, 17*b* extending from two cowl openings 17*a*, 17*a* are collected. The outer vent path 17 is connected to a solenoid valve 22 by way of a connecting pipe 17*d* with a filter 21 interposed therein. The air vent path 14 is connected to the solenoid valve 22.

It is to be noted that the cowl openings 17*a* are positioned sufficiently spaced away from the front face air intake 1*a* so as to prevent carbureted gas which is acted upon by a pressure equal to that of air taken into the intake duct 1 and flows back in the outer vent path 17 from being retaken into the intake duct 1.

Further, in the embodiment, the carburetor 3 is shown as of the four barrel type wherein the air vent path 14 is branched so as to be introduced to the float chambers 12 at four locations. Further, the reason why the outer vent path 17 is complicatedly zigzagged vertically from the branch pipes 17*b* to the collecting pipe 17*c* thereof is that it is intended to prevent admission of water.

Figure 5:
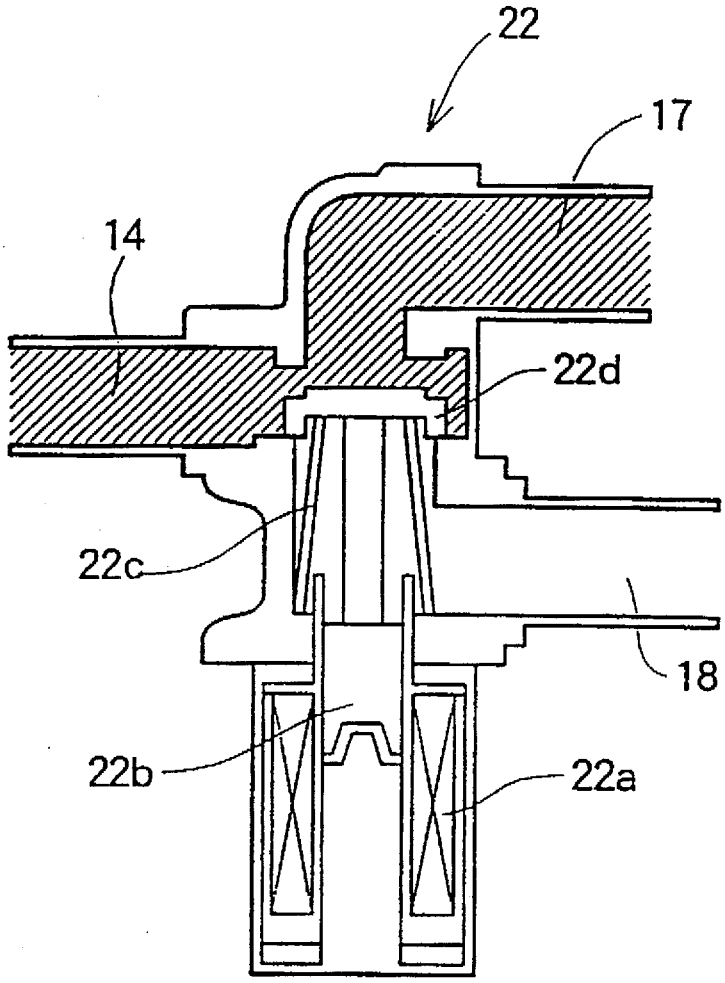
FIG. 5 shows a sectional view of an internal structure of an electromagnetic valve.

The inner vent path 18 has, as shown in FIG. 3, an opening 18*a* provided on the left side of an intermediate portion of the intake duct 1 in the advancing direction. The opening 18*a* is connected to the solenoid valve 22 by connecting pipe 18*b* by way of a filter 24. The solenoid valve 22 is constructed as an electromagnetic change-over valve which operates in response to on/off operation of the ignition plug and the velocity of the vehicle. As shown in FIG. 5, if electric current flows through a coil 22*a*, a plunger 22*b* is attracted to interrupt the inner vent path 18 by means of a valve member 22*d* while allowing the outer vent path 17 to be in communication with the air vent path 14. If the supply of the electric current is stopped, then the valve member 22*d* is urged upwardly by the force of a spring 22*c* to interrupt the outer vent path 17 while allowing the inner vent path 18 to be in communication with the air vent path 14.

Figure 7:
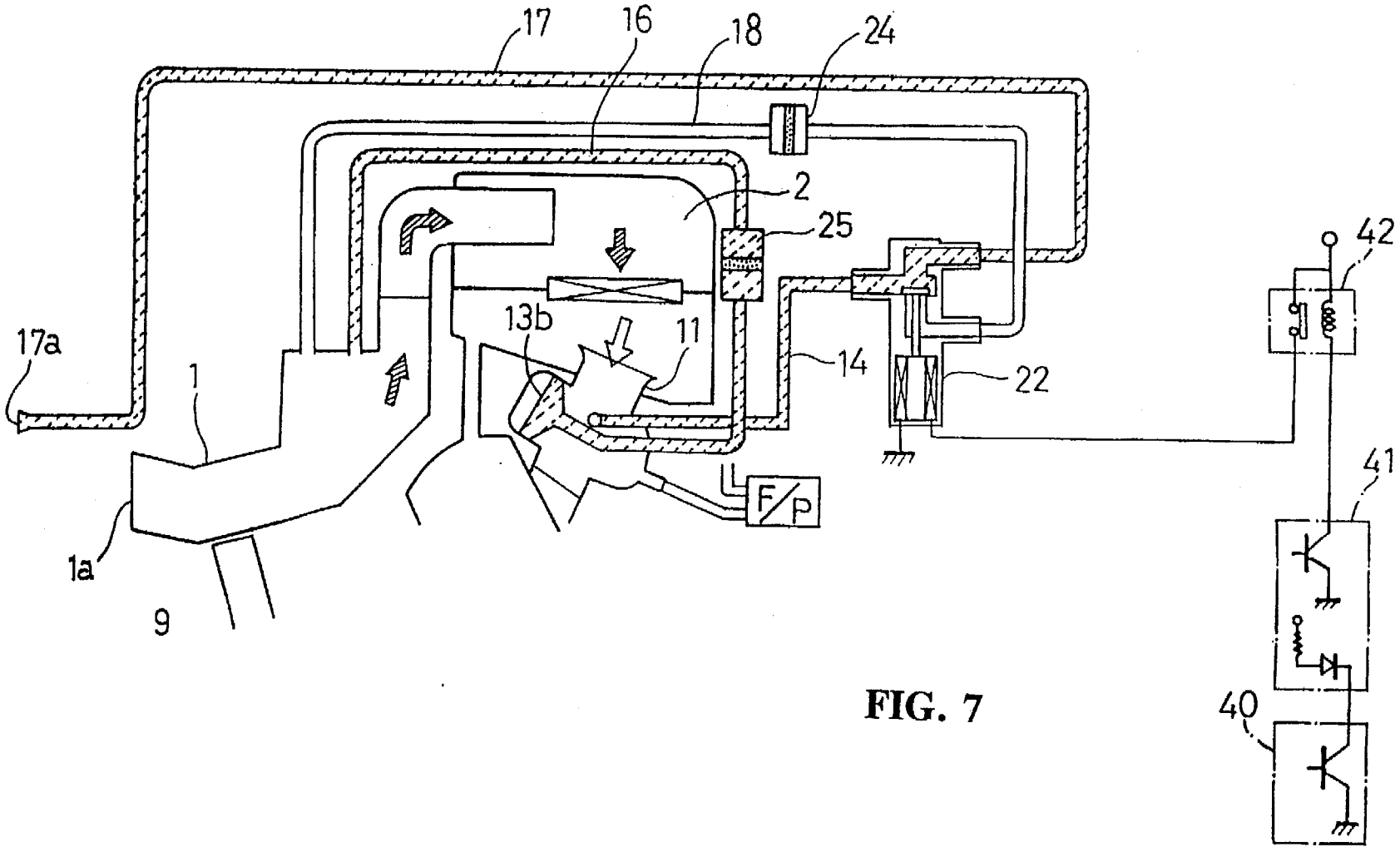
FIG. 7 shows an operation diagram of an entire system when the velocity is 0 to 20 km/H.
Figure 8:
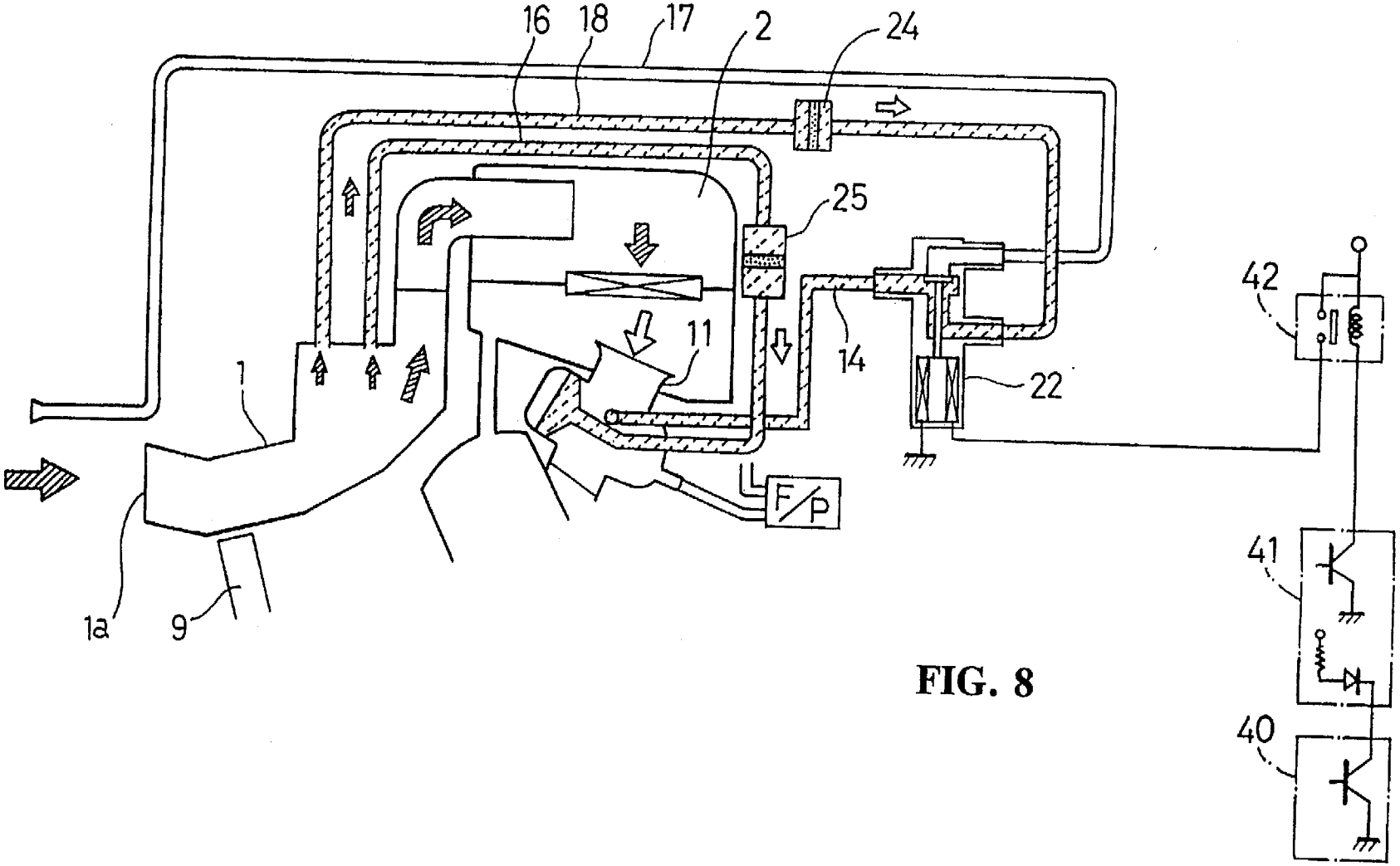
FIG. 8 shows an operation diagram of the entire system when the velocity is higher than 20 km/H.

Further, the electric current to the coil 22*a* is controlled not only in response to on/off operation of the ignition plug but also in response to the velocity of the vehicle. In particular, as shown in FIG. 7, a normally closed relay 42 is interposed intermediately between a wiring line interconnecting the solenoid valve 22 and the ignition coil. The normally closed relay 42 is controlled with a velocity signal detected by a speed sensor 40. In particular, as shown in FIG. 7, when the velocity is equal to or lower than 20 km/H, the normally closed relay 42 is put into a closed condition. When the velocity is higher than 20 km/H, the normally closed relay 42 is put into an open condition as shown in FIG. 8. The reason for changing the solenoid valve 22 at the vehicle velocity of 20 km/H is that, when the vehicle velocity is higher than this velocity, even if fuel carbureted in the float chamber 12 flows back through the vent path, the engine will not adversely be effected. It is to be noted that a speedometer 41 is also shown.

Further in FIG. 3, on the right side in the advancing direction of an intermediate portion in the intake duct 1, an end opening 16*b* of the diaphragm air path 16 is opened. A diaphragm filter 25 is provided intermediately at the end of the diaphragm air path 16.

Operation of the air vent apparatus for a carburetor constructed in such a manner as described above will be described with reference to FIGS. 7 and 8. Here, FIG. 7 is an operation diagram when the ignition plug is on and the velocity is equal to or lower than 20 km/H. FIG. 8 is an operation diagram when the velocity is higher than 20 km/H. As shown in FIG. 7, when the ignition coil is on and the velocity is equal to or lower than 20 km/H, the measurement value by the speed sensor 40 indicates a value equal to or lower than 20 km/H. The normally closed relay 42 is in a closed condition and the plunger 22*b* of the solenoid valve 22 is attracted by the coil 22*a* so that the outer vent path 17 is selected. In short, air admitted through the outer vent path 17 on the upstream side is sent into the float chamber 12 (FIG. 6) of the carburetor 3.

Consequently, even if fuel in the float chamber 12 is carbureted by heat of the engine while the motorcycle is running at a low velocity equal to or lower than 20 km/H, the fuel gas will flow back through the outer vent path 17. Since the cowl openings 17*a* of the outer vent path 17 are sufficiently spaced away from the air intake 1*a* of the intake duct 1, there is no possibility that the fuel gas may be taken in from the front face air intake 1*a* to put the fuel air rate into a bad condition.

Subsequently, as shown in FIG. 8, if the ignition plug is on and the velocity is higher than 20 km/H, then the measurement value measured by the speed sensor 40 indicates a value higher than 20 km/H. The normally closed relay 42 is put into an open condition and the attraction force of the coil 22*a* of the solenoid valve 22 is lost so that the inner vent path 18 side is selected. In particular, the plunger 22*b* is pushed up by the spring 22*c*, and air admitted in through the inner vent path 18 on the upstream side is sent into the float chamber 12 (FIG. 6) of the carburetor 3. In this instance, in this velocity region, the influence of retaking of carbureted gas flowing back from the float chamber 12 is small. Since the air in the inner vent path 18 and the air supplied into intake paths 11 are admitted in from the same intake duct 1 and are in a well balanced condition with each other, a fuel air mixture of a high degree of accuracy is obtained.

Figure 9:
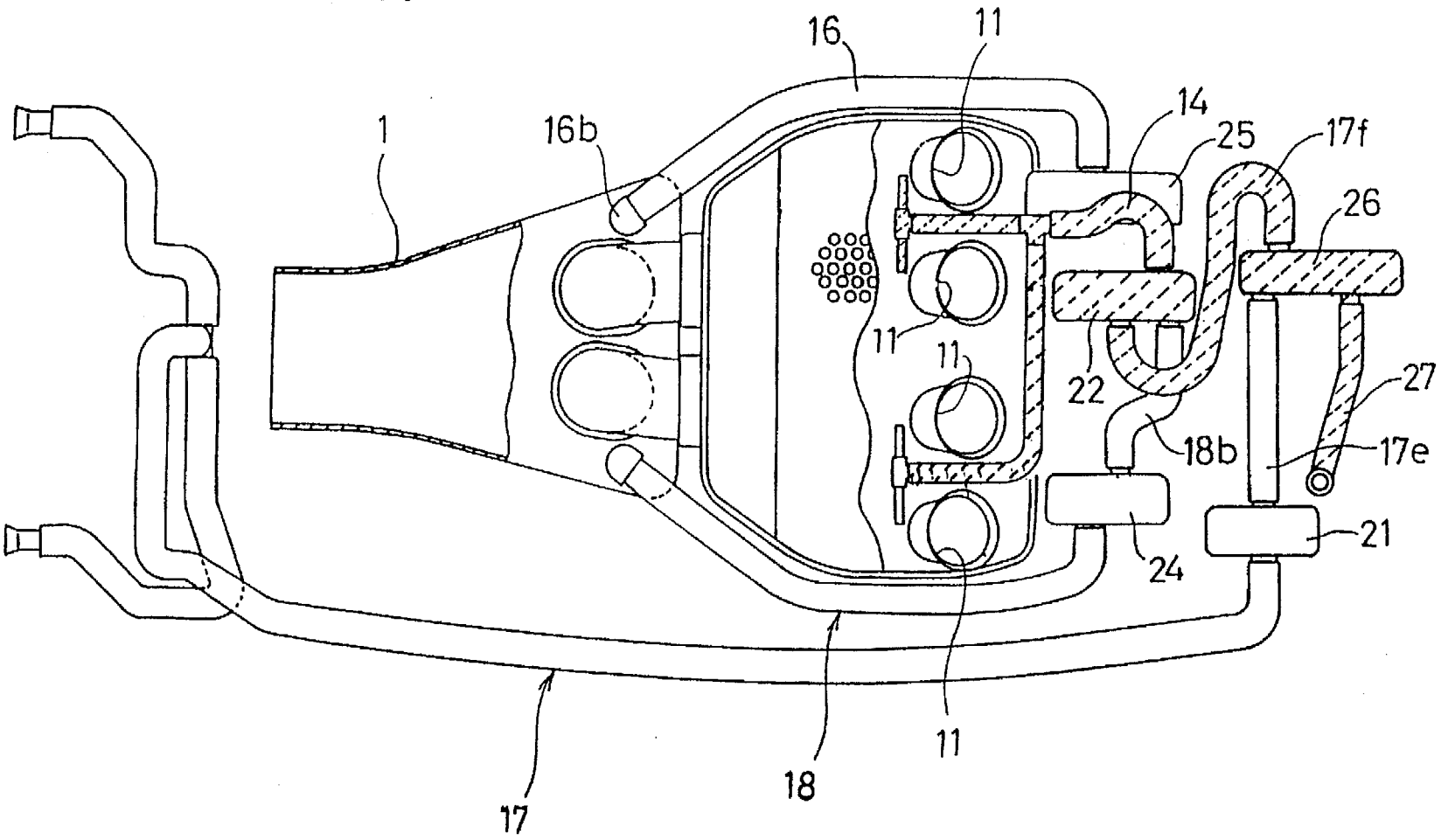
FIG. 9 shows an operation diagram of a second embodiment and a view of a communication condition of a vent path when an ignition plug is off.
Figure 10:
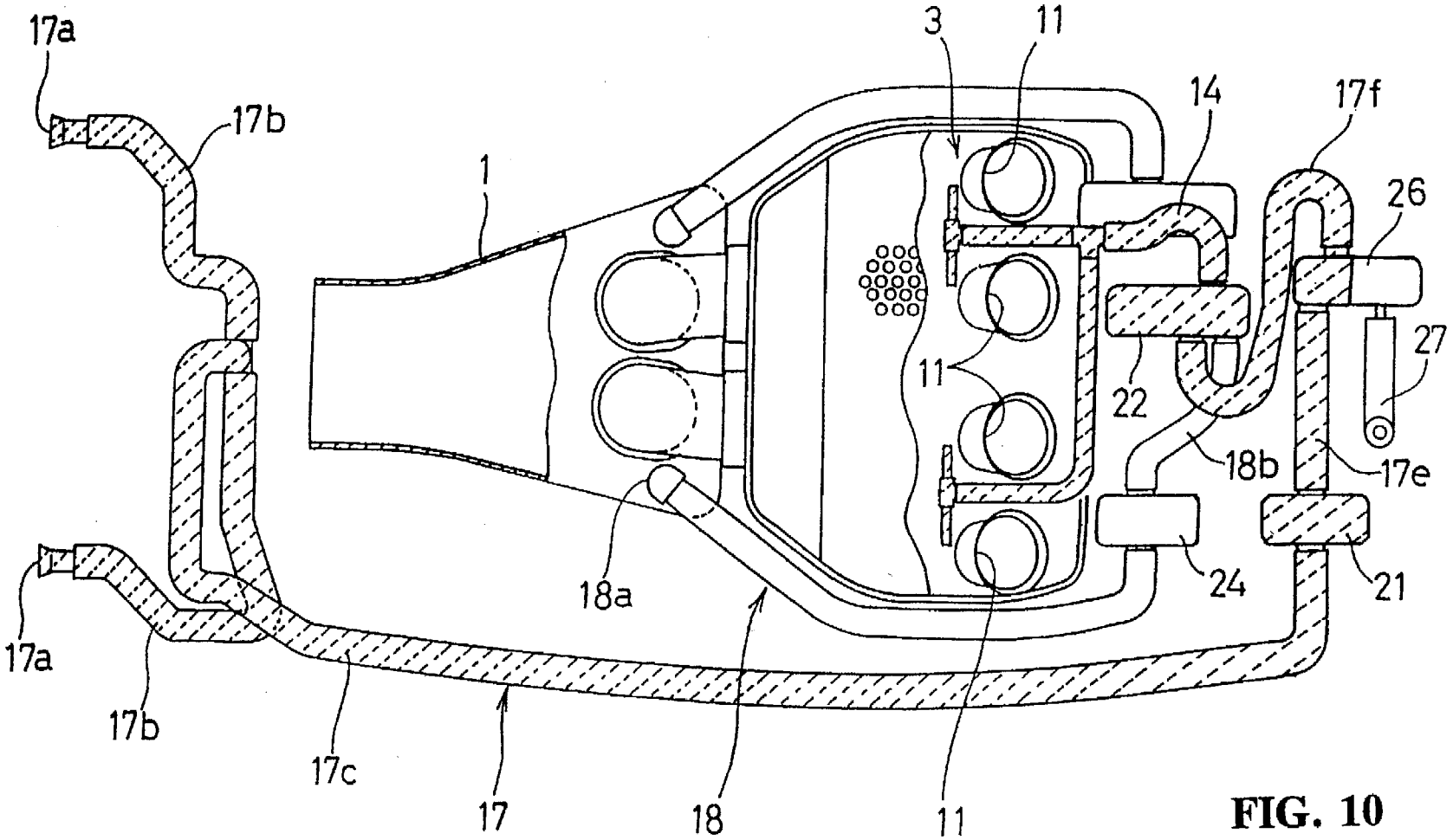
FIG. 10 shows an operation diagram of the second embodiment and a view of a communication condition of the vent path when the velocity is 0 to 20 km/H.
Figure 11:
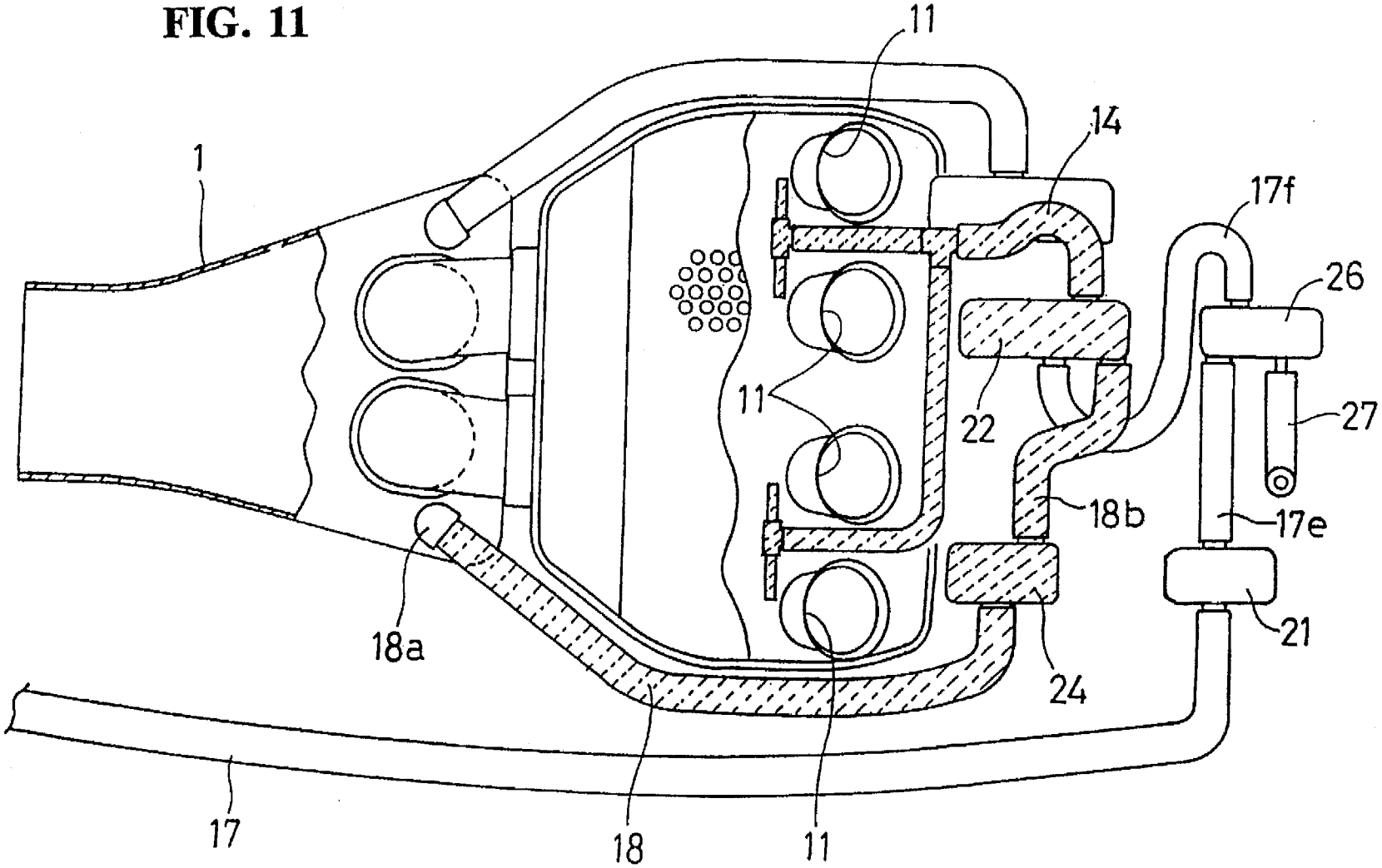
FIG. 11 shows an operation diagram of the second embodiment and a view of a communication condition of the vent path when the velocity is higher than 20 km/H.

Subsequently, a second embodiment will be described with reference to FIGS. 9 to 11. Here, FIG. 9 is an operation diagram when an ignition plug is off. FIG. 10 is an operation diagram when the velocity is equal to or lower than 20 km/H. FIG. 11 is an operation diagram when the velocity is higher than 20 km/H. Further, in those figures, like elements to those described above are denoted by like reference numerals. In the second embodiment the air vent path 14 is connected to a canister when the ignition coil is switched off, and to this end, a new second solenoid valve 26 is provided. The filter 21 of the outer vent path 17 and the second solenoid valve 26 are connected to each other by way of a connecting pipe 17*e* while the second solenoid valve 26 and the solenoid valve 22 are connected to each other by a connecting pipe 17*f*. A canister path 27 is connected to the second solenoid valve 26 so as to be in communication with the canister (not shown).

Also the second solenoid valve 26 has the same construction as that of the solenoid valve 22. When the ignition coil is switched off (FIG. 9), the connecting pipe 17*f* and the canister path 27 are in communication with each other, but when the ignition coil is turned on (FIGS. 10 and 11), the connecting pipe 17*e* and the connecting pipe 17*f* are in communication with each other. In this instance, if the ignition coil is switched off, since the float chamber 13 and the canister path 27 are in communication with each other, carbureted fuel is introduced into the canister, in which it is attracted to activated carbon in the inside.

It is to be noted that, since the action when the velocity is equal to or lower than 20 km/H (FIG. 10) and the action when the velocity is higher than 20 km/H (FIG. 11) are the same as those of the first embodiment. Therefore, the description thereof is now omitted.

Figure 12:
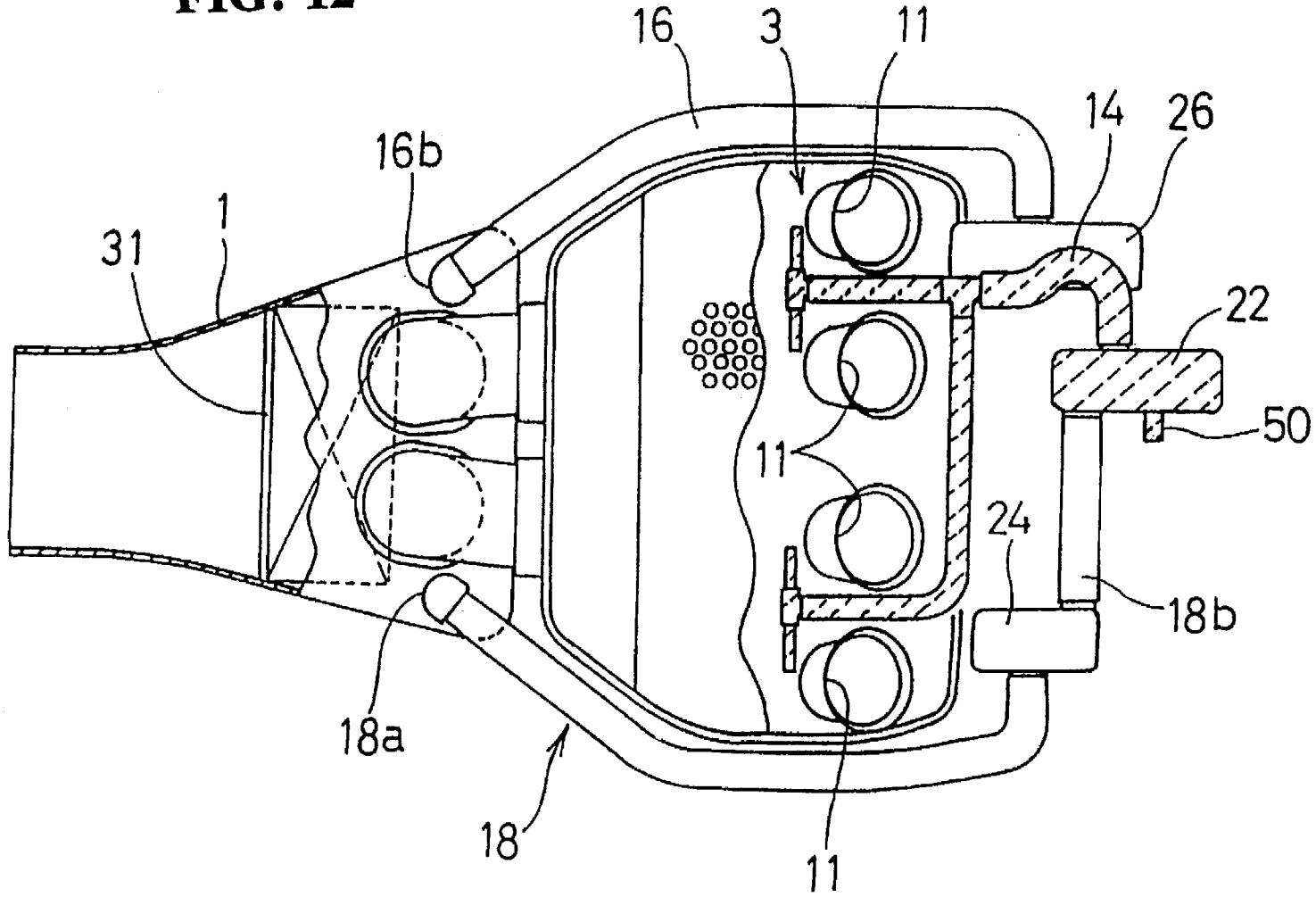
FIG. 12 shows an operation diagram of a third embodiment and a view of a communication condition of a vent path when the velocity is 0 to 20 km/H.
Figure 13:
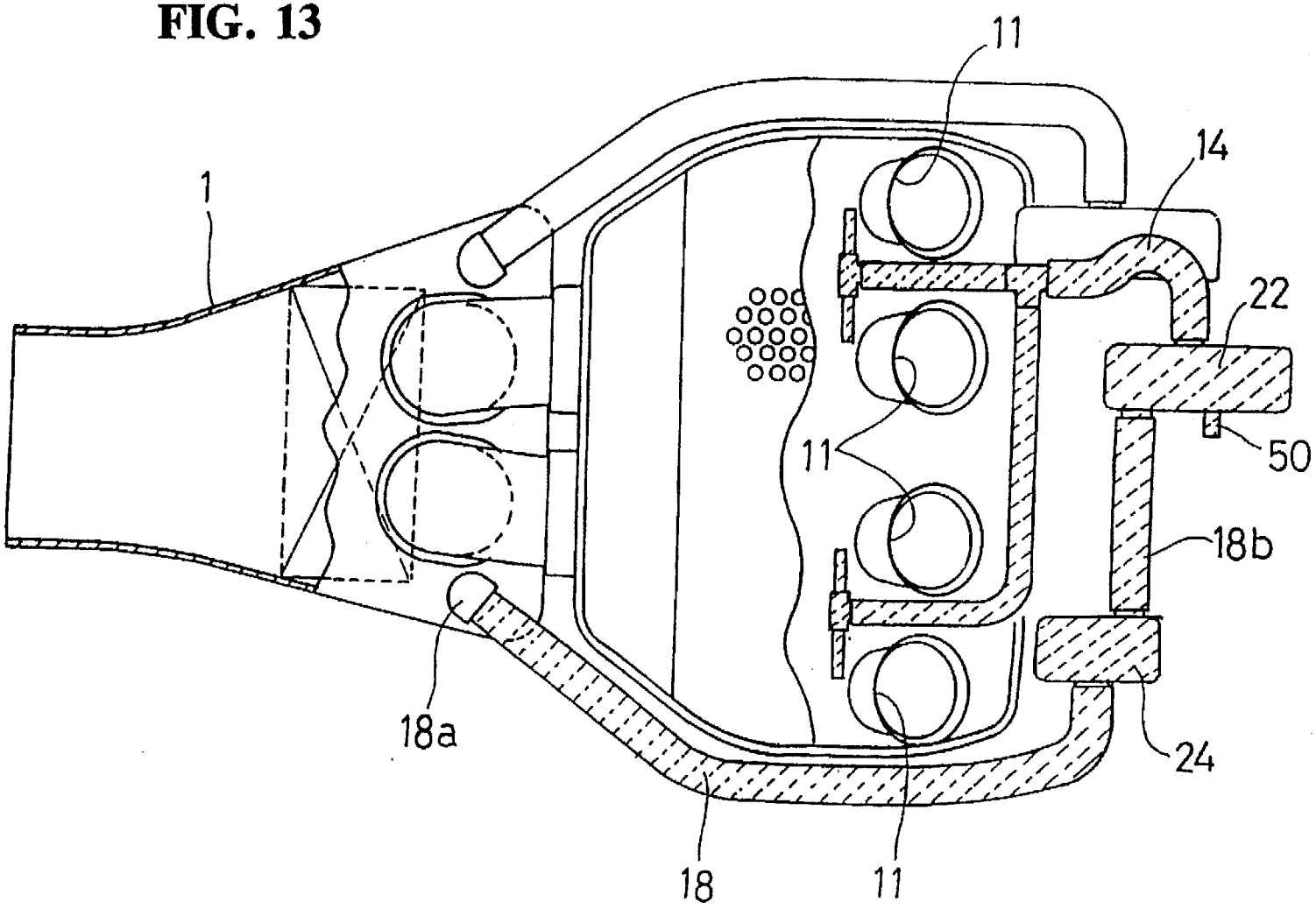
FIG. 13 shows an operation diagram of the third embodiment and a view of a communication condition of the vent path when the velocity is higher than 20 km/H.
Figure 14:
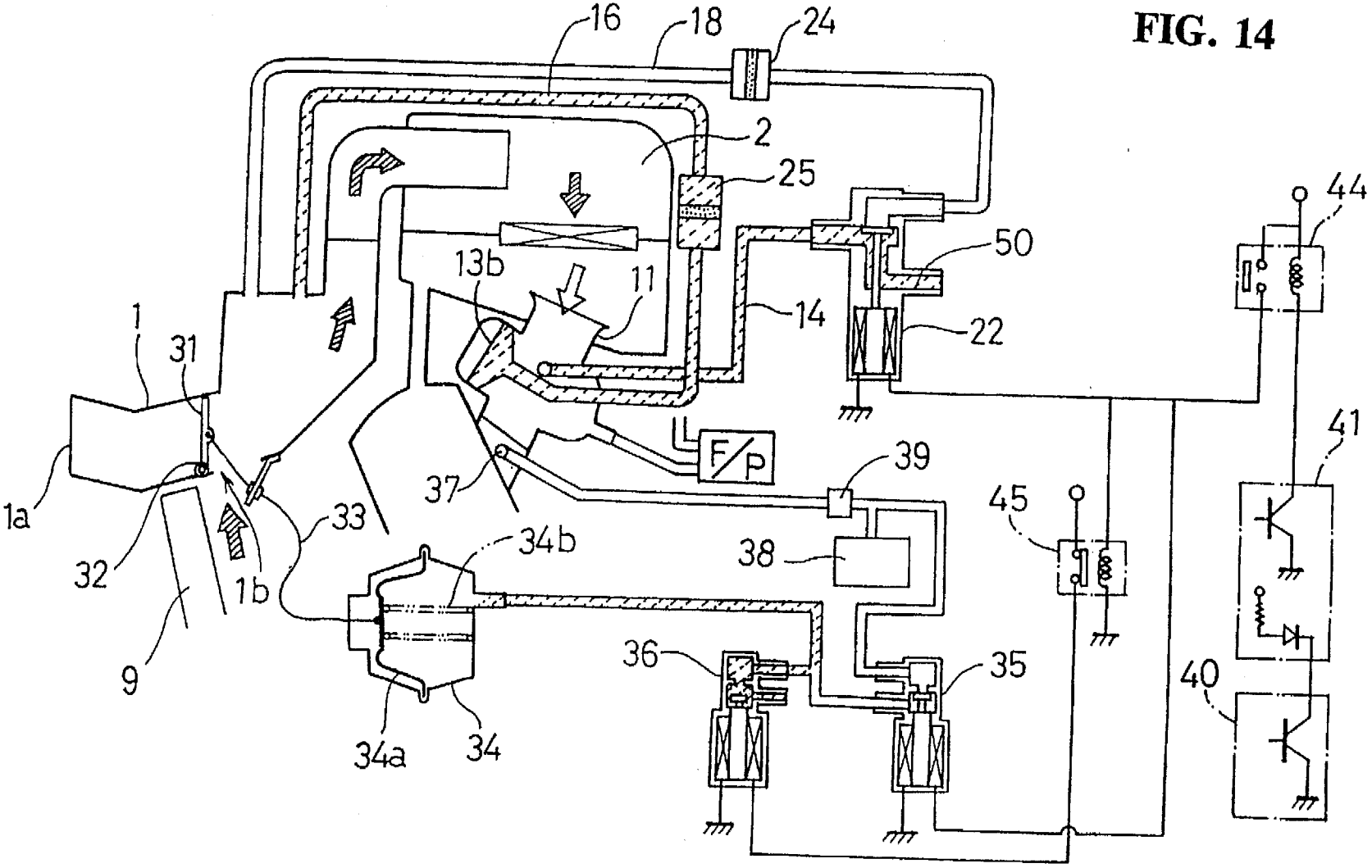
FIG. 14 shows a view of a construction of an entire system of the third embodiment and an operation diagram when the velocity is 0 to 20 km/H.
Figure 15:
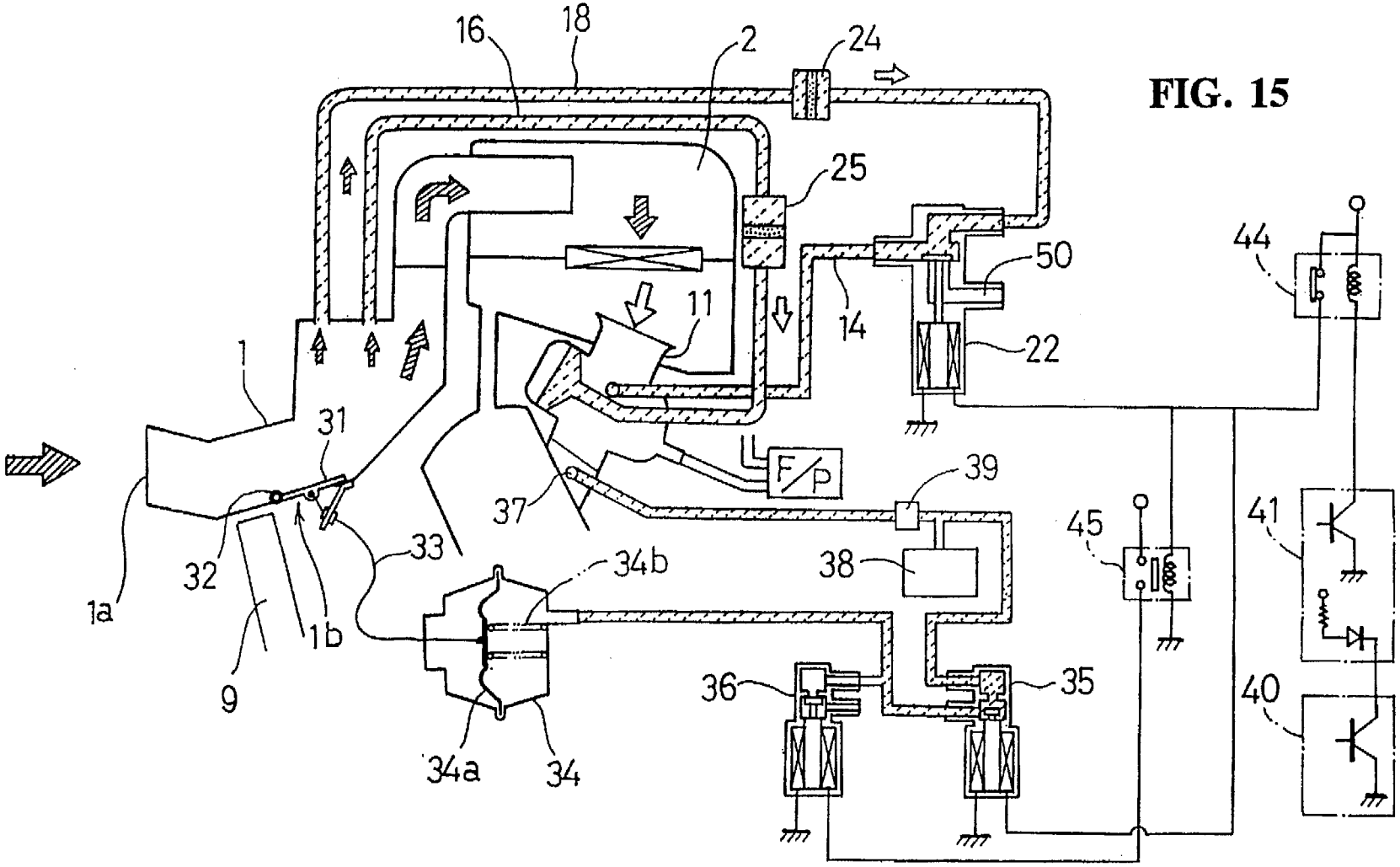
FIG. 15 shows a view of a construction of the entire system of the third embodiment and an operation diagram when the velocity is higher than 20 km/H.

Subsequently, a third embodiment will be described with reference to FIGS. 12 to 15. Here, FIGS. 12 and 13 are operation diagrams of the air vent apparatus as viewed in plan. FIGS. 14 and 15 are operation diagrams of the entire system. FIGS. 12 and 14 are operation diagrams when the velocity is equal to or lower than 20 km/H and FIGS. 13 and 15 are operation diagrams when the velocity is higher than 20 km/H. In the third embodiment, the outer vent path 17 described above is omitted, and instead, a flap 31 is provided in the intake duct 1. By means of the flap 31, a location where a variation in pressure is less likely influenced by a variation in atmospheric pressure when the vehicle is stopped or is running at a low velocity and water is less likely admitted is opened as an air inlet port.

In particular, as shown in FIG. 14, a lower face air intake 1*b* is provided on a lower face in the intake duct 1 which is a little rearwardly of the radiator 9 and is less likely to be influenced by a pressure of a running wind, a gust of wind or the like. The flap 31 is mounted for rocking motion by means of a hinge 32 in proximity to a front edge of the lower face of air intake 1*b*. The lower face air intake 1*b* or the front face air intake 1*a* is alternatively selected and opened by rocking motion of the flap 31. The flap 31 is normally biased by a spring provided for the hinge 32 in a direction in which the front face of the intake duct 1 is closed (in a direction in which the front face air intake 1*a* is closed and the lower face air intake 1*b* is opened). When the velocity of the vehicle becomes higher than 20 km/H, the lower face air intake 1*b* is closed while the front face air intake 1*a* is opened.

To this end, a cable 33 is connected to the rear face of the flap 31, and an actuator 34 of the negative pressure utilization type is connected to the cable 33. This actuator 34 is selectively operated by a negative pressure solenoid valve 35 and an atmospheric air solenoid valve 36. The negative pressure solenoid valve 35 and the atmospheric air solenoid valve 36, as shown in FIG. 14, are controlled by a normally open relay 44 and a normally closed relay 45 which operate in response to detection velocities of the speed sensor 40 and the speedometer 41. The actuator 34 is operated using a negative pressure of an engine manifold extracted from a negative pressure output port 37. It is to be noted in FIG. 14 that a vacuum tank 38 and a one-way valve 39 are provided.

Further, as shown in FIG. 12, an atmospheric air opening circuit 50 is provided in place of the outer vent path connected to the solenoid valve 22. The atmospheric air opening circuit 50 is opened to atmospheric air in the rear of the carburetor 3. The connecting pipe 18*b* of the inner vent path 18 and the atmospheric air opening circuit 50 are alternatively selected by the solenoid valve 22. Incidentally, the rear of the carburetor 3 to which the atmospheric air opening circuit 50 is opened is a location which is not acted upon by a pressure of a running wind.

Operation of the flap type third embodiment will now be described. As shown in FIGS. 12 and 14, if the speed sensor 40 detects a velocity equal to or lower than 20 km/H, then the normally open relay 44 remains open and the negative pressure solenoid valve 35 interrupts the negative pressure. Meanwhile, the normally closed relay 45 remains closed and the atmospheric air solenoid valve 36 is in a communicated condition with the atmospheric air. Consequently, the atmospheric air is admitted in, and the drawing force of the cable 33 by a diaphragm 34*a* is lost. Accordingly, the flap 31 is put into a vertically standing posture (a condition wherein the front face air intake 1*a* is closed and the lower face air intake 1*b* is opened). Further, the solenoid valve 22 is simultaneously selected to the side on which the atmospheric air opening circuit 50 is opened. In short, the air vent path 14 and the atmospheric air opening circuit 50 are in communication with each other, and air is introduced into the intake duct 1 through the lower face air intake 1*b*.

On the other hand, as shown in FIGS. 13 and 15, if the velocity of the vehicle becomes higher than 20 km/H, then the normally open relay 44 is closed and the negative pressure solenoid valve 35 is put into a condition wherein it is communicated with the negative pressure side. Meanwhile, the normally closed relay 45 is opened and the atmospheric air solenoid valve 36 is put into a condition wherein it interrupts the atmospheric air. Accordingly, a negative pressure is admitted into the actuator 34 so that the cable 33 is drawn by the diaphragm 34*a*. Consequently, the flap 31 is put into a fallen or lowered posture (a condition wherein the front face air intake 1*a* is opened and the lower face air intake 1*b* is closed). Further, the solenoid valve 22 is simultaneously selected to the inner vent path 18 side. In short, the air vent path 14 and the inner vent path 18 are in communication with each other, and air is introduced into the intake duct 1 through the front face air intake 1*a*.

In the third embodiment, the atmospheric air opening circuit 50 is provided in place of the outer vent path 17. Since the atmospheric air opening circuit is provided at a location which is not influenced by a running wind and the air intake of the intake duct 1 during low velocity running is set to the lower face air intake 1*b* which is less likely influenced by a variation in pressure, the disadvantage of a pressure difference being produced between the air pressure in the air intake path and the air pressure in the air vent path is prevented. Such an occurrence could be caused, for example, by a gust of wind during low velocity running or by passing of another vehicle or the like. Accurate air fuel mixture can therefore be obtained. Further, since water cannot readily enter the lower face air intake 1*b*, even if the vehicle is washed using steam or the like, there is no disadvantage that water will enter the air cleaner 2 or the like.

It is to be noted that the operation mechanism for the flap 31 is not limited to the actuator 34 of the negative pressure utilization type as in the disclosed embodiments. For example, the flap 31 may be operated by an electric rotary solenoid or a motor, or by an actuator attached directly to the flap 31 without using the cable 33. Alternatively, the flap 31 may be operated by adjustment of the load of a spring pressure of a running wind without using an actuator.

As described above, an air vent apparatus for a carburetor of the present invention is constructed such that an air vent path is alternatively communicated with the atmospheric air or the air intake path in response to on/off operation of an engine starter switch and a predetermined velocity of a vehicle. Therefore particularly during low velocity running, carbureted fuel is prevented from flowing back and entering the air intake path. The fuel air ratio can therefore always be accurately kept.

Further, where an air intake to the air intake path is alternatively selected by a flow path changing member and, in such a case wherein the air vent path is changed over to the atmospheric air side upon low velocity running, the flow path changing member is changed over in response to such changing over. The air intake is then opened to a location where the air intake is less likely influenced by a gust of wind or the like. Then the air pressures of the air in the air vent path and the air to be taken in from the air intake path can be balanced with each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air vent apparatus for a carburetor for a vehicle, the vehicle having an engine, the carburetor having a float chamber, the air vent apparatus comprising:

an air vent path in communication with the float chamber of the carburetor;

an air intake path;

means for alternatively connecting the air vent path to one of atmospheric air and to the air intake path, the means for alternatively connecting being responsive to a predetermined velocity of said vehicle, pressure in the intake path being risen as a running velocity rises, the means for alternatively connecting connects the float chamber to the atmospheric air when the vehicle is running at a velocity which is equal to or lower than the predetermined velocity and connects the float chamber to the air intake path when the vehicle is running at a velocity which is higher than the predetermined velocity.

2. The air vent apparatus for a carburetor according to claim 1, wherein the means for alternatively connecting is a change-over valve.

3. The air vent apparatus for a carburetor according to claim 2, wherein an opening on an atmospheric side for the change-over valve is provided at a location where a pressure is generally equal to a pressure of intake air and carbureted gas fails to flow back into the air intake path.

4. The air vent apparatus for a carburetor according to claim 3, wherein the change-over valve is an electromagnetic change-over valve which operates in response to predetermined velocity of the vehicle.

5. The air vent apparatus for a carburetor according to claim 3, wherein the air intake path comprises a plurality of air intake portions and wherein the air vent apparatus further comprises a flow path changing member which operates in response to a predetermined velocity of the vehicle, the flow path changing member being provided in the air intake path, the air intake to the air intake path being alternately selected by operation of the flow path changing member.

6. The air vent apparatus for a carburetor according to claim 5, wherein the flow path changing member selects less likely to be effected by a variation in pressure and where admission of water is less likely to occur.

7. The air vent apparatus for a carburetor according to claim 2, wherein the change-over valve is an electromagnetic change-over valve which operates in response to a predetermined velocity of the vehicle.

8. The air vent apparatus for a carburetor according to claim 7, wherein the air intake path comprises a plurality of air intake portions and wherein the air vent apparatus further comprises a flow path changing member which operates in response to a predetermined velocity of the vehicle, the flow path changing member being provided in the air intake path, the air intake to the air intake path being alternately selected by operation of the flow path changing member.

9. The air vent apparatus for a carburetor according to claim 8, wherein the flow path changing member selects an air intake portion which is located where air intake is less likely to be effected by a variation in pressure and where admission of water is less likely to occur.

10. The air vent apparatus for a carburetor according to claim 7, wherein the predetermined velocity which the means for alternatively connecting is responsive to is the same predetermined velocity which the change-over valve is responsive to.

11. The air vent apparatus for a carburetor according to claim 1, wherein the air intake path comprises a plurality of air intake portions and wherein the air vent apparatus further comprises a flow path changing member which operates in response to a predetermined velocity of the vehicle, the flow path changing member being provided in the air intake path, the air intake to the air intake path being alternately selected by operation of the flow path changing member.

12. The air vent apparatus for a carburetor according to claim 11, wherein the predetermined velocity which the means for alternatively connecting is responsive to is the same predetermined velocity which the change-over valve is responsive to.

13. The air vent apparatus for a carburetor according to claim 11, wherein the flow path changing member selects an air intake portion which is located where air intake is less likely to be effected by a variation in pressure and where admission of water is less likely to occur.

14. The air vent apparatus for a carburetor according to claim 2, wherein the air intake has an atmospheric opening for admission of atmospheric air and wherein the air vent path on an upstream side of the carburetor comprises an outer vent path and an inner vent path, the outer vent path including a collecting pipe having one end connected to the change-over valve and another end being connected to two branch pipes, the two branch pipes extending from two cowl openings to the collecting pipe, the two cowl openings being spaced from the atmospheric opening of the air intake.

15. The air vent apparatus for a carburetor according to claim 14, wherein the outer vent path has a zigzagged course to prevent admission of water to the carburetor.

16. The air vent apparatus for a carburetor according to claim 14, wherein the air vent path further comprises an inner vent path, one end of the inner vent path being connected to the change-over valve by a connecting pipe and another end being connected to an opening provided above the atmospheric opening of the air intake.

17. The air vent apparatus for a carburetor according to claim 2, wherein the vehicle has an engine starter switch and wherein the change-over valve is responsive to on and off operation of the engine starter and to the predetermined velocity of the vehicle and wherein the air vent apparatus further comprises a second change-over valve, the second change-over valve being connected to the air vent path on an upstream side of the carburetor, a connecting pipe being provided between the second change-over valve and the first change-over valve, the air vent apparatus further comprising a canister path for connecting a canister to the second change-over valve, when the engine starter switch is switched off, the connecting pipe and the canister path being in communication through the second change-over valve and when the engine starter switch is switched on, the connecting pipe and the air vent path being in communication through the second change-over valve.

18. The air vent apparatus for a carburetor according to claim 2, wherein the air vent path includes an intake duct with a flap provided therein.

19. The air vent apparatus for a carburetor according to claim 2, further comprising means for activating the flap to move the flap between a first position and a second position, a lower air intake being provided in the intake duct, the flap closing the intake duct while opening the lower air intake when in the first position, the flap opening the intake duct while closing the lower air intake when in the second position.

20. An air vent apparatus for a carburetor for a vehicle, the vehicle having an engine and an engine starter switch, the carburetor having a float chamber, the air vent apparatus comprising:

an air vent path in communication with the float chamber of carburetor;

an air intake path having an atmospheric opening for admission of atmospheric air; and a change-over valve for alternatively connecting the air vent path to one of atmospheric air and to the air intake path, the change-over valve being responsive to on and off operation of the engine starter and to a predetermined velocity of said vehicle, the air vent path on an upstream side of the carburetor having an outer vent path and an inner vent path, the outer vent path including a collecting pipe having one end connected to the change-over valve and another end being connected to two branch pipes, the two branch pipes extending from two cowl openings to the collecting pipe, the two cowl openings being spaced from the atmospheric opening of the air intake.

21. The air vent apparatus for a carburetor according to claim 20, wherein the outer vent path has a zigzagged course to prevent admission of water to the carburetor.

22. The air vent apparatus for a carburetor according to claim 20, wherein the air vent path further comprises an inner vent path, one end of the inner vent path being connected to the change-over valve by a connecting pipe and another end being connected to an opening provided above the atmospheric opening of the air intake.

23. The air vent apparatus for a carburetor according to claim 20, wherein an opening on an atmospheric side for the change-over valve is provided at a location where a pressure is generally equal to a pressure of intake air and carbureted gas fails to flow back into the air intake path.

24. The air vent apparatus for a carburetor according to claim 20, wherein the change-over valve is an electromagnetic change-over valve which operates in response to operation of the engine starter switch and in response to predetermined velocity of the vehicle.

* * * * *